US008518320B2

(12) United States Patent
Steckl et al.

(10) Patent No.: US 8,518,320 B2
(45) Date of Patent: Aug. 27, 2013

(54) METHODS FOR ELECTROSPINNING HYDROPHOBIC COAXIAL FIBERS INTO SUPERHYDROPHOBIC AND OLEOPHOBIC COAXIAL FIBER MATS

(75) Inventors: Andrew J. Steckl, Cincinnati, OH (US); Daewoo Han, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 423 days.

(21) Appl. No.: 12/784,964

(22) Filed: May 21, 2010

(65) Prior Publication Data

US 2010/0297906 A1 Nov. 25, 2010

Related U.S. Application Data

(60) Provisional application No. 61/180,284, filed on May 21, 2009.

(51) Int. Cl.
*D01D 5/34* (2006.01)
*D06M 10/00* (2006.01)

(52) U.S. Cl.
USPC ..... 264/465; 264/172.15

(58) Field of Classification Search
USPC ..... 264/172.11, 172.15, 464, 465, 466, 264/484
See application file for complete search history.

(56) References Cited

U.S. PATENT DOCUMENTS

| | | | | |
|---|---|---|---|---|
| 7,575,707 | B2 | 8/2009 | Xia et al. | |
| 2003/0175514 | A1 * | 9/2003 | Hancock et al. | 264/172.15 X |
| 2010/0178505 | A1 * | 7/2010 | Rutledge et al. | 264/465 X |

* cited by examiner

*Primary Examiner* — Leo B Tentoni
(74) *Attorney, Agent, or Firm* — Dinsmore & Shohl LLP

(57) ABSTRACT

Methods for electrospinning a hydrophobic coaxial fiber into a superhydrophobic coaxial fiber mat can include providing an electrospinning coaxial nozzle comprising a core outlet coaxial with a sheath outlet, ejecting an electrospinnable core solution from the core outlet of the electrospinning coaxial nozzle, ejecting a hydrophobic sheath solution from the sheath outlet of the electrospinning coaxial nozzle, wherein the hydrophobic sheath solution annularly surrounds the core solution, applying a voltage between the electrospinning coaxial nozzle and a collection plate, wherein the voltage induces a jet of the electrospinnable core solution annularly surrounded by the hydrophobic sheath solution to travel from the electrospinning coaxial nozzle to the collection plate to form the hydrophobic coaxial fiber comprising an electrospinnable polymer core coated with a hydrophobic sheath material, and wherein collection of the hydrophobic coaxial fiber on the collection plate yields the superhydrophobic coaxial fiber mat.

11 Claims, 4 Drawing Sheets

METHODS FOR ELECTROSPINNING HYDROPHOBIC COAXIAL FIBERS INTO SUPERHYDROPHOBIC AND OLEOPHOBIC COAXIAL FIBER MATS

CROSS-REFERENCE TO RELATED APPLICATIONS

This application claims the benefit of U.S. Provisional Application No. 61/180,284, filed May 21, 2009, which application is hereby incorporated by reference in its entirety.

TECHNICAL FIELD

The present specification generally relates to electrospinnable fibers and, more specifically, to hydrophobic coaxial fibers produced by coaxial electrospinning.

BACKGROUND

Superhydrophobic materials and surfaces that produce water contact angles in excess of 150° are being intensively studied in order to provide superior water repellency and self-cleaning behavior. This unique property is very useful in many industries, such as microfluidics, textiles, construction, automobiles, and so forth. Many examples of superhydrophobicity are found in nature, especially in plants and insects. For example, lotus leaves are superhydrophobic because of their rough-surface microstructure. Self-cleaning occurs as water droplets remove surface particles as they roll off the leaves. Superhydrophobicity also provides good buoyancy for floating on water. Another example from nature is the lady's mantle leaf that obtains its superhydrophobicity from a fur-like coverage of bundled hairs. Interestingly, individual hairs are hydrophilic. However, the elastic deformation of the bundled hair ends away from the substrate results in a superhydrophobic surface. The bundling of the hairs is an example of the importance of curvature in hydrophobicity. This curvature effect is also very important in determining the oil-repellent ("oleophobic") properties of the surface. Water strider feet and bird feathers are other famous examples of superhydrophobicity present in nature. By observing these features, one realizes that superhydrophobicity results from a combination of low surface energy and high surface roughness.

Several approaches have been reported for combining materials of low surface energy with high surface roughness. One approach is to roughen a normally smooth surface of a hydrophobic material. Plasma etching is widely used for this purpose. Mechanical stretching and microphase separation of fluorinated block copolymers have also been used. A second approach is to treat a rough surface with a hydrophobic material. Etching, lithography, and nanowires/nanotubes by chemical vapor deposition (CVD) have been used to produce a rough surface, followed by a hydrophobic coating to produce a low surface energy. Whereas these approaches are two-step processes, single-step approaches, such as sol-gel phase separation and plasma polymerization, can also produce a rough surface with low surface energy.

Electrospinning is a versatile technique for producing micro-nanofibers from many kinds of polymers. In a laboratory environment, electrospinning requires a high-power supply, a conducting substrate, and a syringe pump. The electrospinning process is initiated by a high electric field between the syringe containing viscous polymer solution) and the conducting substrate. Because of the high electrical potential, a charged liquid jet is ejected from the tip of a distorted droplet, the so-called Taylor cone. This liquid jet experiences whipping and bending instabilities within a sufficient distance to evaporate its solvent thoroughly and, consequently, becomes a solid nonwoven micro/nanofiber membrane on the substrate. Oriented polymer nanofibers can also be produced by modifying the ground electrode geometry and/or rotating it and by using a microfluidic chip to deliver the solution to the ejection tip.

However, due to their relatively low dielectric constants, many hydrophobic materials are not susceptible to electrospinning. Electrospinning has been used to make membranes with rough surfaces, followed by the deposition of hydrophobic material. For example, rough membranes are electrospun first and then coated with hydrophobic material by deposition techniques such as CVD and the layer-by-layer technique. However, this process can require additional cost and material to sufficiently coat the electrospun membrane.

Accordingly, a need exists for alternative methods for electrospinning hydrophobic coaxial fibers into superhydrophobic coaxial fiber mats.

SUMMARY

In one embodiment, a method for electrospinning a hydrophobic coaxial fiber into a superhydrophobic coaxial fiber mat is provided. The method may include providing an electrospinning coaxial nozzle comprising a core outlet coaxial with a sheath outlet, ejecting an electrospinnable core solution from the core outlet of the electrospinning coaxial nozzle, ejecting a hydrophobic sheath solution from the sheath outlet of the electro spinning coaxial nozzle, wherein the hydrophobic sheath solution annularly surrounds the core solution, applying a voltage between the electrospinning coaxial nozzle and a collection plate, wherein the voltage induces a jet of the electrospinnable core solution annularly surrounded by the hydrophobic sheath solution to travel from the electrospinning coaxial nozzle to the collection plate to form the hydrophobic coaxial fiber comprising an electrospinnable polymer core coated with a hydrophobic sheath material, and wherein collection of the hydrophobic coaxial fiber on the collection plate yields the superhydrophobic coaxial fiber mat.

In another embodiment, a superhydrophobic coaxial fiber mat includes an electrospun hydrophobic coaxial fiber, wherein the electrospun hydrophobic coaxial fiber includes an electrospinnable polymer coated with a hydrophobic sheath material, the hydrophobic sheath material comprising 1 weight percent to 10 weight percent of the superhydrophobic coaxial fiber mat, and wherein, the superhydrophobic coaxial fiber mat possesses a contact angle greater than or equal to 150° with water.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
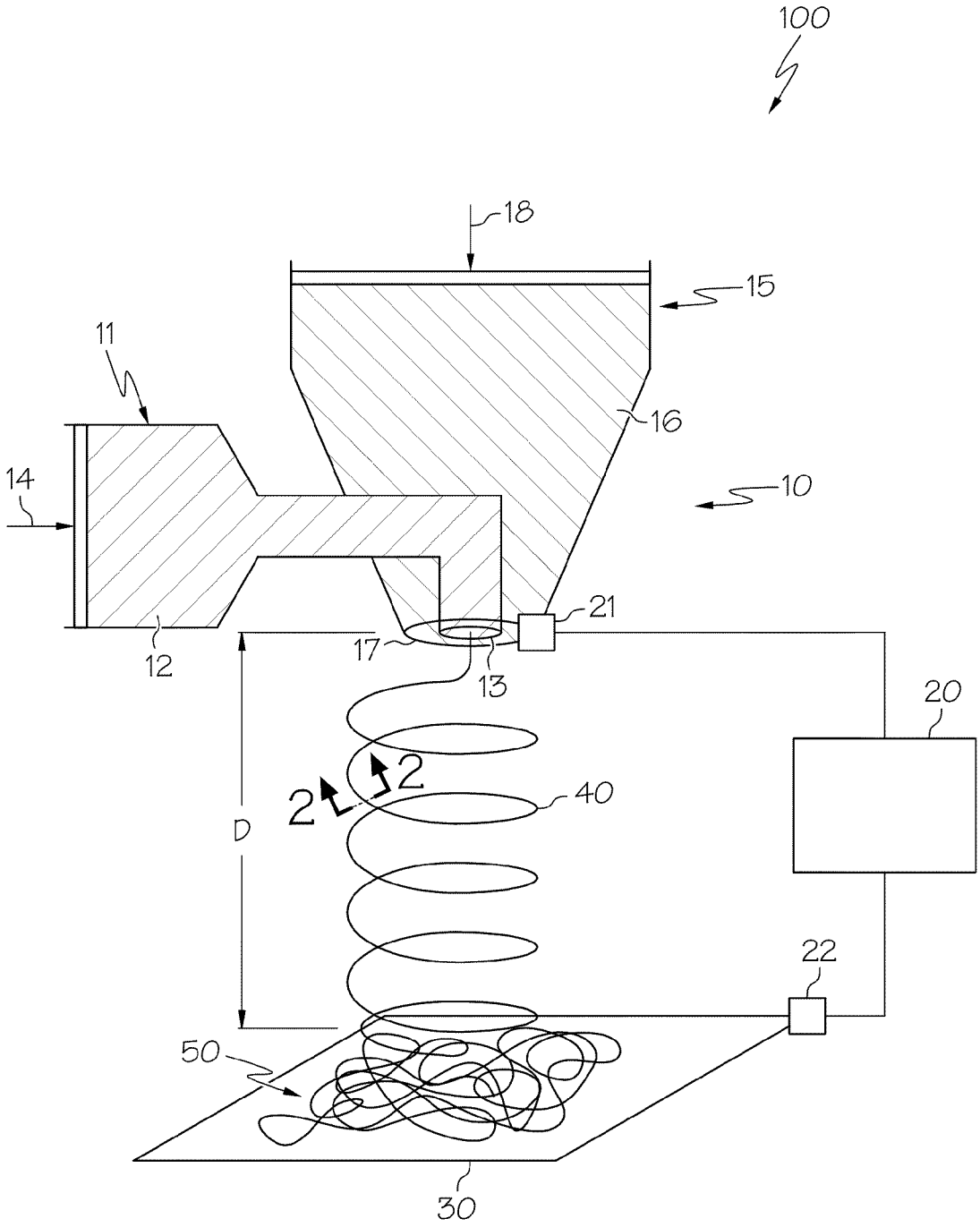
FIG. 1 depicts a hydrophobic coaxial fiber electrospinning system according to one or more embodiments shown and described herein.

As used herein with the various illustrated embodiments described below, the follow terms include, but are not limited to, the following meanings.

The term "electrospinning" can mean applying an electric field between a nozzle containing an electrospinnable polymer and a conducting substrate (such as by applying a voltage between the two) such that a charged liquid jet of the electrospinnable core solution containing the electrospinnable polymer is ejected from the tip of a distorted droplet from the nozzle (i.e., the so-called Taylor cone) and experiences whipping and bending instabilities for a sufficient distance to evaporate its solvent thoroughly and, consequently, become a solid electrospinnable polymer core.

The term "electrospinning coaxial nozzle" can mean a conductive nozzle comprising a core outlet coaxial with a sheath outlet.

The term "electrospinnable core solution" can mean an electrospinnable polymer and a core solvent.

The term "electrospinnable polymer" can mean any polymer sufficient to hold a charge such that an electric field can electrospin the electrospinnable polymer, such as, for example, synthetic polymers (e.g., poly(∈-caprolactone) (PCL), poly(methyl methacrylate) (PMMA), nylon, polyurethane, poly-lactic gycolic acid (PLGA), polyethylene, poly (lactic acid), poly(ethylene oxide), polystyrene, polycarbonate, polyvinyl alcohol (PVA), polyvinylpyrrolidone (PVP), polyacrylonitrile (PAN), or NOMEX (poly(isophthaloylchloride/m-phenylenediamine) manufactured by DuPont)), biomaterials (e.g., DNA-CTMA, cellulose acetate, collagen, gelatin, or chitosan), and the like.

The term "core solvent" can mean any solvent that dissolves the electrospinnable polymer to comprise the electrospinnable core solution, such as, for example an organic solvent (e.g., trifluoroethanol (TFE), hexafluoro-iso-propanol (HFIP), chloroform (CF), tetrahydrofuran (THF), dimethylformamide (DMF), or methylene chloride), an aqueous solvent (e.g., water or formic acid such as for example), and the like.

The term "hydrophobic sheath solution" can mean a hydrophobic material and a sheath solvent.

The term "hydrophobic material" can mean any material that can coat the electrospinnable polymer core and provide hydrophobic and/or oleophobic properties, such as, for example, an amorphous fluoropolymer and the like.

The term "sheath solvent" can mean any solvent that dissolves the hydrophobic material to comprise the hydrophobic sheath solution, such as, for example, perfluoro(butyltetrahydrofuran), perfluorohexane, other fluorinert compounds, perfluoro compounds, and the like.

The term "hydrophobic coaxial fiber" can mean a an electrospinnable polymer core coated with a hydrophobic sheath material.

The term "superhydrophobic coaxial fiber mat" can mean one or more electrospun hydrophobic coaxial fibers gathered together in a random or oriented configuration to provide superhydrophobic properties.

The term "hydrophobic" can mean possessing a contact angle greater than or equal to 90° with water.

The term "superhydrophobic" can mean possessing a contact angle greater than or equal to 150° with water.

The term "oleophobic" can mean possessing an alkane contact angle greater than or equal to 90° with alkanes.

Figure 2:
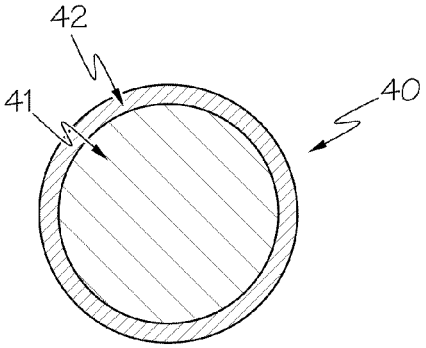
FIG. 2 depicts a cross-sectional view of a hydrophobic coaxial fiber according to one or more embodiments shown and described herein.
Figure 3:
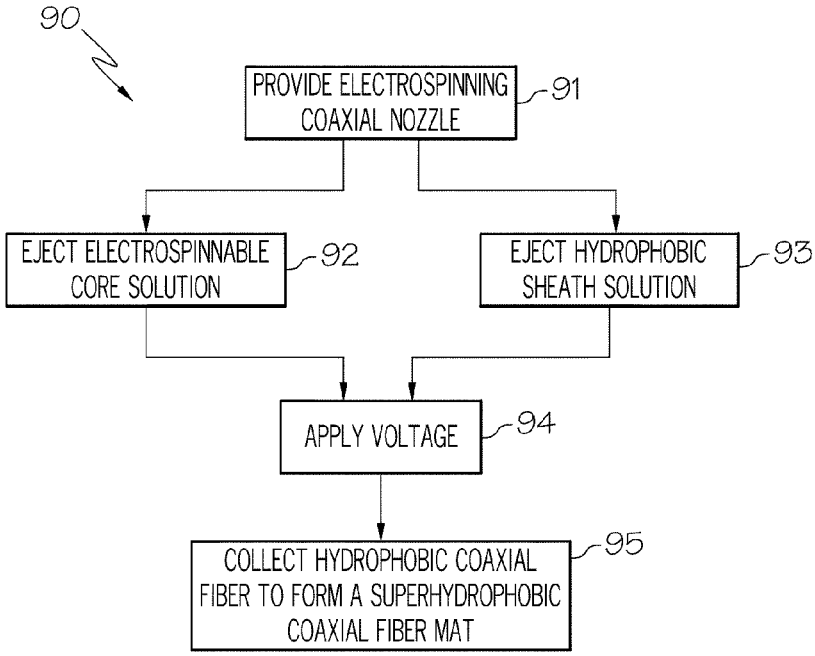
FIG. 3 depicts a method for electrospinning a hydrophobic coaxial fiber mat according to one or more embodiments shown and described herein.
Figure 5A:
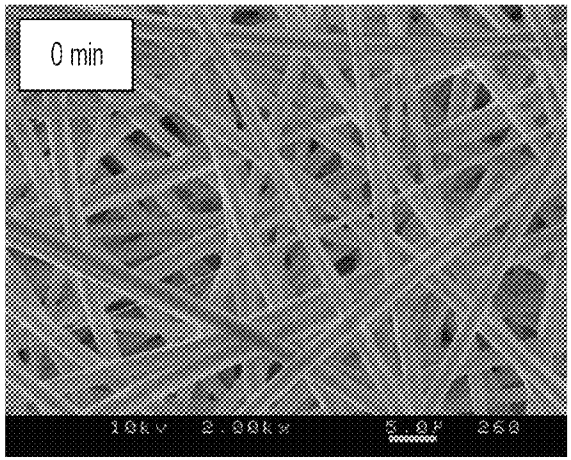
FIG. 5A contains a micrograph showing the effect of trifluoroethanol vapor on a superhydrophobic coaxial fiber mat at 0 minutes according to one or more embodiments shown and described herein.
Figure 5B:
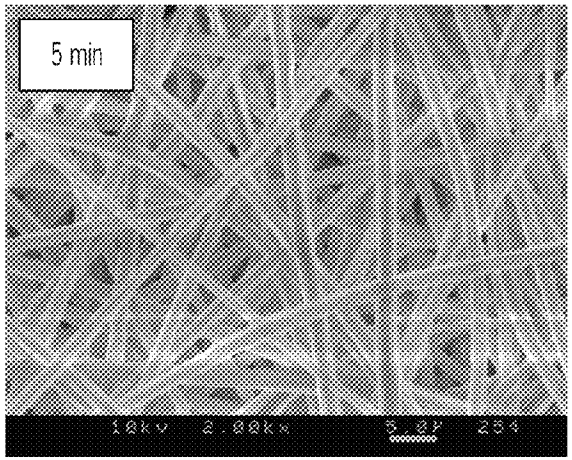
FIG. 5B contains a micrograph showing the effect of trifluoroethanol vapor on a superhydrophobic coaxial fiber mat at 5 minutes according to one or more embodiments shown and described herein.
Figure 5C:
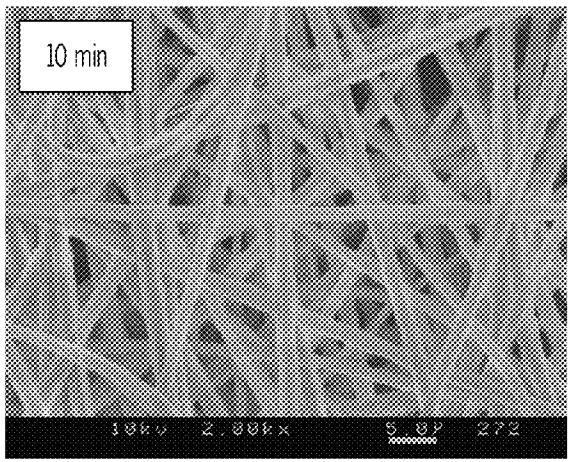
FIG. 5C contains a micrograph showing the effect of trifluoroethanol vapor on a superhydrophobic coaxial fiber mat at 10 minutes according to one or more embodiments shown and described herein.
Figure 5D:
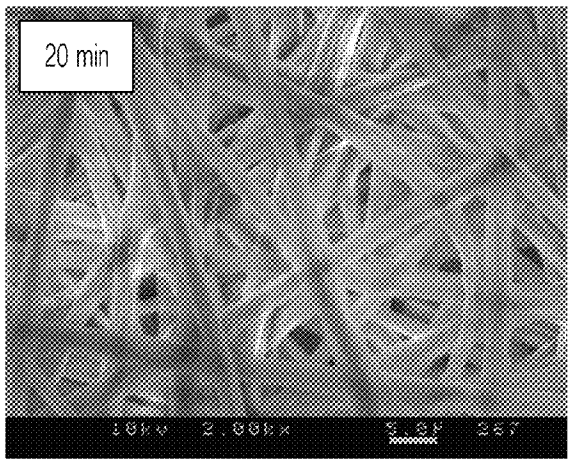
FIG. 5D contains a micrograph showing the effect of trifluoroethanol vapor on a superhydrophobic coaxial fiber mat at 20 minutes according to one or more embodiments shown and described herein.
Figure 6A:
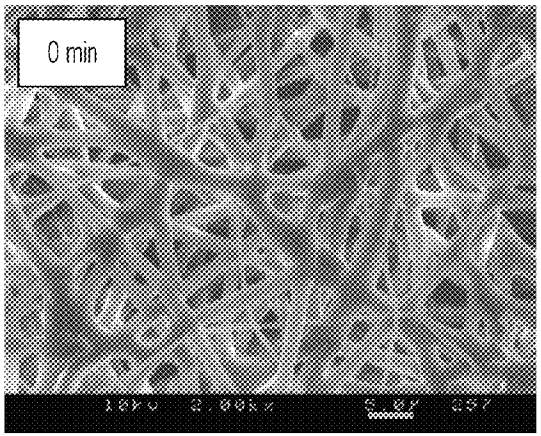
FIG. 6A contains a micrograph showing the effect of trifluoroethanol vapor on an electrospun fiber mat at 0 minutes according to one or more embodiments shown and described herein.
Figure 6B:
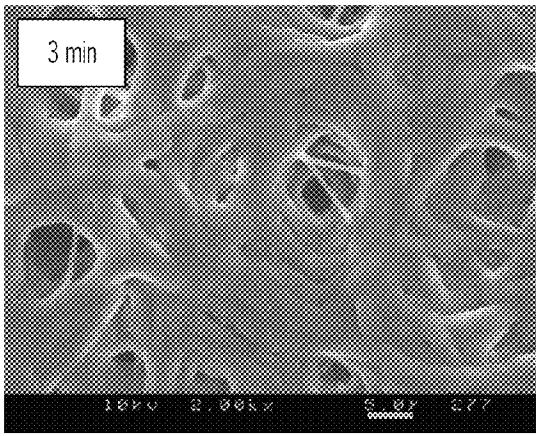
FIG. 6B contains a micrograph showing the effect of trifluoroethanol vapor on an electrospun fiber mat at 3 minutes according to one or more embodiments shown and described herein.
Figure 6C:
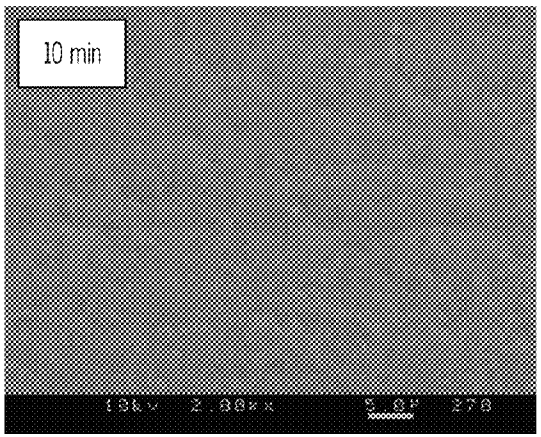
FIG. 6C contains a micrograph showing the effect of trifluoroethanol vapor on an electrospun fiber mat at 10 minutes according to one or more embodiments shown and described herein.
Figure 6D:
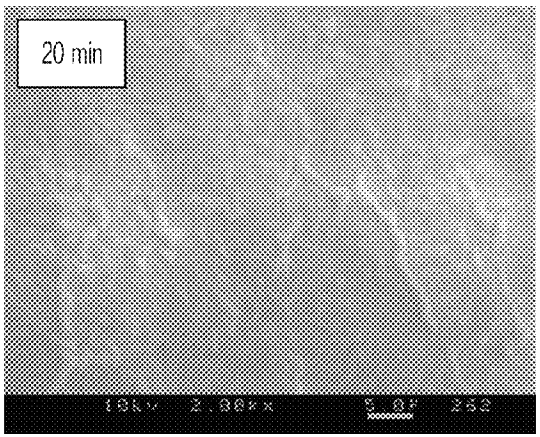
FIG. 6D contains a micrograph showing the effect of trifluoroethanol vapor on an electrospun fiber mat at 20 minutes according to one or more embodiments shown and described herein.

FIGS. 1-3 generally depicts one embodiment of a hydrophobic coaxial fiber electrospinning system 100 that can be used in a method 90 for electrospinning a hydrophobic coaxial fiber 40 into a superhydrophobic coaxial fiber mat 50. The hydrophobic coaxial fiber electrospinning system 100 generally comprises an electrospinning coaxial nozzle 10 at a distance D from a collection plate 30 with a power supply 20 supplying a voltage between the two. The electrospinning coaxial nozzle 10 includes a core container 11 connected to a core outlet 13 and a sheath container 15 connected to a sheath outlet 17. The sheath outlet 17 can be coaxial with and surround the core outlet 13. An electrospinnable core solution 12 can thus be ejected from the core outlet 13 and a hydrophobic sheath solution 16 can be concurrently ejected from the sheath outlet 17 such that a jet of electrospinnable core solution 12 is ejected and annularly surrounded by the hydrophobic sheath solution 16. The voltage supplied between the electrospinning coaxial nozzle 10 and the collection plate 30 can temporarily charge the electrospinnable core solution 12 causing the electrospinnable core solution 12 annularly surrounded by the hydrophobic sheath solution 16 to travel to the collection plate 30. As the electrospinnable core solution 12 annularly surrounded by the hydrophobic sheath solution 16 travels from the coaxial nozzle 10 to the collection plate 30, the solvents in both solutions evaporate such that a hydrophobic coaxial fiber 40 comprising an electrospinnable polymer core 41 coated with a hydrophobic sheath material 42 is formed (as seen in FIG. 2). The hydrophobic coaxial fiber 40 may thereby be collected as a superhydrophobic coaxial fiber mat 50 with hydrophobic and oleophobic properties. Various embodiments of the hydrophobic coaxial fiber electrospinning system 100 and methods for electrospinning hydrophobic coaxial fibers 40 into superhydrophobic coaxial fiber mats 50 will be described in more detail herein.

Referring now to FIGS. 1-3, a method 90 for electrospinning a hydrophobic coaxial fiber 40 into a superhydrophobic coaxial fiber mat 50 is provided. The method 90 first comprises providing a coaxial nozzle 10 in step 91. The electrospinning coaxial nozzle 10 provided in step 91 of method 90 can comprise any conductive material such that a voltage supplied from a power supply 20 can be transferred to the core solution 16 as will become appreciated herein. For example, the electrospinning coaxial nozzle 10 can comprise any conductive metal, alloy, or other electrically conductive material. As seen in FIG. 1, the electrospinning coaxial nozzle 10 comprises a core outlet 13 coaxial with a sheath outlet 17. The core outlet 13 can be connected to a core container 11 that can contain an electrospinnable core solution 12 as will become appreciated later herein. The core container 11 can comprise any material, shape and characteristics to store and provide the electrospinnable core solution 12 to the core outlet 13. Likewise, the sheath outlet 17 can similarly be connected to a sheath container 15 containing a hydrophobic sheath solution 16 as will also become appreciated later herein. The sheath container 15 can comprise any material, shape and characteristics to store and provide the hydrophobic sheath solution 16 to the sheath outlet 17. The electrospinning coaxial nozzle 10 can comprise any dimensions that allow a coaxial fiber to be electrospun therefrom. For example, in one embodiment, the diameter of the core outlet 13 may comprise from about 0.1 millimeters (mm) to 0.5 mm, from about 0.2 mm to about 0.4 mm, or about 0.3 mm. The sheath outlet 17 may comprise an outer diameter and an inner diameter such that a ring of hydrophobic sheath solution 16 is ejected from the sheath outlet 17 which annularly surrounds the electrospinnable core solution 12. For example, in one embodiment, the sheath outlet 17 may comprise an outer diameter from about 0.6 mm to about 1.0 mm, from about 0.7 mm to about 0.9 mm or about 0.8 mm. Likewise, the sheath outlet 17 may comprise an inner diameter from about 0.4 mm to about 0.8 mm, from about 0.5 mm to about 0.7 mm, or about 0.5 mm. In one exemplary embodiment, the electrospinning coaxial nozzle 10 provided in step 91 of method 90 may allow for the core solution 12 to be ejected with a diameter of about 0.3 mm while the hydrophobic sheath solution 16 is ejected from the coaxial electrospinning coaxial nozzle 10 with an outer diameter of about 0.8 mm and an inner diameter of about 0.6 mm. While specific dimensions have been provided with reference to the core outlet 16 and the sheath outlet 17 of the electrospinning coaxial nozzle 10, the dimensions are exemplary only and other dimensions may alternatively be used.

As illustrated in FIG. 1, in one embodiment, the electrospinning coaxial nozzle 10 can further comprise a core container 11 connected to the core outlet 13 and a sheath container 15 connected to the sheath outlet 17, such as, for example a plastic syringe, vessel or the like. In such an embodiment, the core container 11 and the sheath container 15 may comprise any container operable to hold a volume of electrospinning core solution 12 and hydrophobic sheath solution 16 respectively. The core container 11 and the sheath container 15 can keep the electrospinnable core solution 12 separate from the hydrophobic sheath solution 16 until they are both ejected from the electrospinning coaxial nozzle 10 as will become appreciated herein. In an alternative embodiment, the electrospinning coaxial nozzle 10 can be connected to a sources of the electrospinning core solution 12 and hydrophobic sheath solution 16 via any other mechanism that keeps the two solutions separate until they are ejected from the core outlet 13 and the sheath outlet 17 respectively. For example, sources of the electrospinning core solution 12 and the hydrophobic sheath solution 16 can be connected to the core cutlet 13 and the sheath outlet 17 via tubes, hoses, or any other operable device for transporting and guiding the solution to its respective outlet.

Referring back to method 90 for electrospinning a hydrophobic coaxial fiber 40 into a superhydrophobic coaxial fiber mat 50, an electrospinnable core solution 12 is ejected from the core outlet 13 of the coaxial nozzle 10 in step 92. The electrospinnable core solution 12 can comprise an electrospinnable polymer and a core solvent. The electrospinnable polymer can comprise any polymer sufficient to hold a charge such that an electric field can electrospin the electrospinnable polymer. Specifically, the polymer must hold a sufficient charge so that the electric field (created by applying a voltage between the electrospinning coaxial nozzle 10 and the collection plate 30) causes the electrospinnable polymer in the ejected electrospinnable core solution 12 to form an electrospinnable polymer core 41 of an electrospun hydrophobic coaxial fiber 40. For example, the electrospinnable can comprise a synthetic polymer (such as, for example, poly(∈-caprolactone) (PCL), poly(methyl methacrylate) (PMMA), nylon, polyurethane, poly-lactic gycolic acid (PLGA), polyethylene, poly(lactic acid), poly(ethylene oxide), polystyrene, polycarbonate, polyvinyl alcohol (PVA), polyvinylpyrrolidone (PVP), polyacrylonitrile (PAN), or NOMEX (poly (isophthaloylchloride/m-phenylenediamine) from DuPont)), a biomaterial (such as, for example, DNA-CTMA, cellulose acetate, collagen, gelatin, or chitosan) or combinations thereof. While these materials are listed as potential electrospinnable polymers for the electrospinnable core solution 12, this list is exemplary only and other electrospinnable polymers may additionally or alternatively be used.

The core solvent of the electrospinnable core solution 12 can comprise any solvent that dissolves the electrospinnable polymer to comprise the electrospinnable core solution 12. For example, the core solvent can comprise an organic solvent (such as, for example, trifluoroethanol (TFE), hexafluoro-iso-propanol (HFIP), chloroform (CF), tetrahydrofuran (THF), dimethylformamide (DMF), or methylene chloride), an aqueous solvent (such as, for example, water or formic acid), or combinations thereof. In one embodiment, the core solvent may be selected based on the particular electrospinnable polymer or electrospinnable polymers in the electrospinnable core solution 12. For example, where the electrospinnable polymer in the electrospinnable core solution comprises poly(∈-caprolactone) or poly(methyl methacrylate), the core solvent may comprise trifluoroethanol. While these solvents are listed as potential core solvents for the electrospinnable core solution 12, this list is exemplary only and other core solvents may alternatively be used to dissolve the electrospinnable polymer to comprise the electrospinnable core solution 12.

The electrospinnable core solution 12 can comprise any relative weight percents of the electrospinnable polymer and the core solvent to allow for the electrospinning of the electrospinnable core solution 12 into the electrospinnable polymer core 41 of the electrospun hydrophobic coaxial fiber 40 as illustrated in FIG. 2. For example, in one embodiment, the electrospinnable polymer may comprise from about 4 weight percent to about 35 weight percent of the electrospinnable core solution 12. In another embodiment, the electrospinnable polymer may comprise from about 7 weight percent to about 15 weight percent of the electrospinnable core solution 12. In yet another embodiment, such as where the electrospinnable core solution 12 comprises poly(∈-caprolactone) and trifluoroethanol the electrospinnable polymer (i.e., the poly(∈-caprolactone)) may comprise about 10 weight percent of the electrospinnable core solution 12.

Furthermore, the electrospinnable core solution 12 ejected from the core outlet 13 of the electrospinning coaxial nozzle 10 in step 92 of method 90 is ejected at a core flow rate. The core flow rate can be a constant flow rate, an incremental flow rate, a variable flow rate or any combination thereof. For example, as illustrated in FIG. 1, in one embodiment, a core pump 14 may act in cooperation with the core container 11 to provide controlled pressure on the electrospinnable core solution 12 disposed within the core container 11 such that the electrospinnable core solution 12 is ejected at a constant core flow rate. In another embodiment, the electrospinnable core solution 12 may be ejected from the core outlet 13 of the electrospinning coaxial nozzle 10 via any other force such as by gravity, motors, or any other form of hydraulic control. The core flow rate can comprise any flow rate operable to allow for the electrospinning of the electrospinnable core solution into the electrospinnable polymer core 41 of the electrospun hydrophobic coaxial fiber 40 as illustrated in FIG. 2. The core flow rate may depend on one or more other electrospinning parameters of the hydrophobic coaxial fiber electrospinning system 100 such as, for example, the type and weight percent of the electrospinnable polymer in the electrospinnable core solution 12, the type and weight percent of the core solvent in the electrospinnable core solution 12, the viscosity of the electrospinnable core solution 12 (which itself can depend on the types and weight percents of the electrospinnable polymer and the core solvent in the electrospinnable core solution 12), the diameter of the core outlet 13, the sheath flow rate, the voltage and/or distance D between the electrospinning coaxial nozzle 10 or the collection plate 30 (as will become appreciated herein), and/or any other electrospinning parameters. In one embodiment, the core flow rate may comprise from about 0.5 milliliters per hour (mL/h), to about 10 mL/h. In another embodiment, such as where the electrospinnable core solution 12 comprises 10 weight percent poly(∈-caprolactone) and 90 weight percent trifluoroethanol, the core flow rate may comprise about 1.5 mL/h.

Referring still to FIGS. 1-3, in addition to ejecting the electrospinnable core solution 12 from the core outlet 13 of the electrospinning coaxial nozzle 10 in step 92 of method 90, a hydrophobic sheath solution 16 is also ejected from the sheath outlet 17 of the electrospinning coaxial nozzle 10 in step 93. The hydrophobic sheath solution 16 can comprise a hydrophobic material and a sheath solvent. The hydrophobic material can comprise any material that can coat the electrospinnable polymer core 41 and provide hydrophobic and/or oleophobic properties to the electrospun hydrophobic coaxial fiber 40 after it is electrospun. In one embodiment, the hydrophobic material can comprise a fluoropolymer, such as, an amorphous fluoropolymer. For example, in one particular embodiment, the hydrophobic material can comprise an amorphous copolymer of polytetrafluoroethylene and 2,2-bis(trifluoromethyl)-4,5,-difluoro-1,3,-dioxole (such as the commercially available amorphous fluoropolymer Teflon AF from DuPont). In another embodiment, the hydrophobic material may comprise CYTOP (amorphous fluoropolymers as commercially available from Asahi Glass) or FLUOROPEL (fluoroaliphatic polymers as commercially available from Cytonix). In yet another embodiment, the hydrophobic material may comprise a combination of fluoropolymers. While these materials are listed as potential hydrophobic materials for the hydrophobic sheath solution 16, this list is exemplary only and other hydrophobic materials may additionally or alternatively be used.

The sheath solvent of the electrospinnable core solution 12 can comprise any solvent that dissolves the hydrophobic material (e.g. the fluoropolymer) to comprise the hydrophobic sheath solution 16. For example, in one embodiment, such as where the hydrophobic sheath material comprises an amorphous copolymer of polytetrafluoroethylene and 2,2-bis(trifluoromethyl)-4,5-difluoro-1,3-dioxole, the sheath solvent may comprise perfluoro(butyltetrahydrofuran) (also known as Fluorinert FC-75, or simply FC-75, and commercially available from 3M), perfluorohexane (also known as Fluorinert FC-72, or simply FC-72, and commercially available from 3M), other Fluorinert compounds like FC-40 (commercially available from 3M), perfluoro compounds, or combinations thereof. In another embodiment, such as where the hydrophobic sheath material comprises CYTOP (amorphous fluoropolymers as commercially available from Asahi Glass), the sheath solvent may comprise CT-solv 180 (commercially available from Asahi Glass), CT-solv 100 (commercially available from Asahi Glass), or combinations thereof. In yet another embodiment, such as where the hydrophobic material comprises FLUOROPEL (fluoroaliphatic polymers commercially available from Cytonix), the sheath solvent may comprise perfluoropolyether (PFPE), perfluoroalkane, halocarbon, hydrofluoroether or combinations thereof. While these solvents are listed as potential sheath solvents for the hydrophobic sheath solution 16, this list is exemplary only and other sheath solvents may alternatively be used to dissolve the hydrophobic material to comprise the hydrophobic sheath solution 16.

The hydrophobic sheath solution 16 can comprise any relative weight percents of the hydrophobic material and the sheath solvent to allow for the hydrophobic sheath material 42 to coat the electrospinnable polymer core 41 of a hydrophobic coaxial fiber 40 from electrospinning as illustrated in FIG. 2. For example, in one embodiment, the hydrophobic material may comprise from about 0.2 weight percent to about 2 weight percent of the hydrophobic sheath solution 16. In another embodiment, the hydrophobic material may comprise from about 0.5 weight percent to about 1 weight percent of the hydrophobic sheath solution 16. In yet another embodiment, such as where the hydrophobic sheath solution 16 comprises Teflon AF 2400 and FC-75, the hydrophobic material (i.e., the Teflon AF 2400) may comprise about 1 weight percent of the hydrophobic sheath solution 16.

Furthermore, the hydrophobic sheath solution 16 ejected from the sheath outlet 17 of the electrospinning coaxial nozzle 10 in step 93 of method 90 is ejected at a sheath flow rate. Similar to the core flow rate, the sheath flow rate can be a constant flow rate, an incremental flow rate, a variable flow rate or any combination thereof. For example, as illustrated in FIG. 1, in one embodiment, a sheath pump 18 may act in cooperation with the sheath container 15 to provide controlled pressure on the hydrophobic sheath solution 16 disposed within the sheath container 15 such that the hydrophobic sheath solution 16 is ejected at a constant sheath flow rate. In another embodiment, the hydrophobic sheath solution 16 may be ejected from the sheath outlet 18 of the electrospinning coaxial nozzle 10 via any other force such as by gravity, motors, or any other form of hydraulic control. The sheath flow rate can comprise any flow rate operable to coat the electrospinnable polymer core 41 with the hydrophobic sheath material 42 to provide hydrophobic and/or oleophobic properties to the hydrophobic coaxial fiber 40 after it is electrospun as illustrated in FIG. 2. The sheath flow rate may depend on one or more other electrospinning parameters of the hydrophobic coaxial fiber electrospinning system 100 such as, for example, the type and weight percent of the electrospinnable polymer in the electrospinnable core solution 12, the type and weight percent of the core solvent in the electrospinnable core solution 12, the viscosity of the electrospinnable core solution 12 (which itself can depend on the types and weight percents of the electrospinnable polymer and the core solvent in the electrospinnable core solution 12), the diameter of the core outlet 13, the sheath flow rate, the voltage and/or distance D between the electrospinning coaxial nozzle 10 or the collection plate 30 (as will become appreciated herein), and/or any other electrospinning parameters. In one embodiment, the sheath flow rate may comprise from about 0.5 milliliters per hour (mL/h), to about 10 mL/h. In another embodiment, such as where the electrospinnable core solution 12 comprises 1 weight percent Teflon AF 2400, the sheath flow rate may comprise about 1.0 mL/h.

Referring now to FIG. 3, ejecting the electrospinnable core solution 12 from the core outlet 13 of the electrospinning coaxial nozzle 10 in step 92 and ejecting the hydrophobic sheath solution 16 from the sheath outlet 17 of the coaxial nozzle 10 in step 93 can occur concurrently such that both solutions are ejected from the respective outlets. In one embodiment, ejecting the electrospinnable core solution 12 from the core outlet 13 of the electrospinning coaxial nozzle 10 in step 92 can start before ejecting the hydrophobic sheath solution 16 from the sheath outlet 17 of the electrospinning coaxial nozzle 10 in step 93 is initiated. In another embodiment, ejecting the hydrophobic sheath solution 16 from the sheath outlet 17 of the electrospinning coaxial nozzle 10 in step 93 can start before ejecting the electrospinnable core solution 12 from the core outlet 13 of the coaxial nozzle 10 in step 92. In yet another embodiment, ejecting the electrospinnable core solution 12 from the core outlet 13 of the electrospinning coaxial nozzle 10 in step 92 and ejecting the hydrophobic sheath solution 16 from the sheath outlet 17 of the electrospinning coaxial nozzle 10 in step 93 may both start substantially simultaneously. It should be appreciated that the start order or time between starting to eject the electrospinnable core solution 12 from the core outlet 13 of the electrospinning coaxial nozzle 10 in step 92 and start to eject the hydrophobic sheath solution 16 from the sheath outlet 17 of the electrospinning coaxial nozzle 10 in step 93 may otherwise vary so long as both solutions are at some point simultaneously ejected as voltage is applied as will become appreciated later herein.

As appreciated to those skilled in the art, the miscibility between the electrospinnable core solution 12 and the hydrophobic sheath solution 16 (and more specifically the electrospinnable polymer and the hydrophobic material) may influence the mechanical properties of the electrospun hydrophobic coaxial fiber 40 and the resulting superhydrophobic coaxial fiber mat 50. For example, immiscible solutions provide for little or no interactions between the electrospinnable polymer core 41 and the hydrophobic sheath material 42. Conversely, miscible solutions may still allow for the electrospinning of hydrophobic coaxial fibers 40; however, the electrospinnable polymer core 41 may possess reduced mechanical strength compared to when used with immiscible solutions. In one embodiment, where the hydrophobic sheath material comprises the relatively immiscible material Teflon, the electrospinnable polymer core may significantly retain its mechanical strength.

Referring now to FIGS. 1-3, as the electrospinnable core solution 12 is ejected in step 92 and the hydrophobic sheath solution 16 is ejected in step 93, a voltage is applied from a power supply 20 between the electrospinning coaxial nozzle 10 and the collection plate 30. Specifically, referring to the hydrophobic coaxial fiber electrospinning system 100 in FIG. 1, the power supply 20 may comprise any device operable to provide sufficient voltage between the electrospinning coaxial nozzle 10 and the collection plate 30 such that it charges the electrospinnable polymer in the electrospinnable core solution 12 wherein the electric field between the electrospinning coaxial nozzle 10 and the collection plate 30 causes the charged electrospinnable polymer whips and bends due to instabilities as it travels from the electrospinning coaxial nozzle 10 and the collection plate 30 such that the solvent evaporates leaving the electrospinnable polymer core 41 of the electrospun hydrophobic coaxial fiber 40 as illustrated in FIG. 2. Furthermore, as the electrospinnable polymer core 41 is electrospun due to the voltage applied in step 94 and the resulting electric field, the sheath solvent in the hydrophobic sheath solution 16 (which is annularly surrounding the electrospinnable core solution 12) also evaporates resulting in a hydrophobic sheath material 42 coating the electrospinnable polymer 41 to form the hydrophobic coaxial fiber as illustrated in FIG. 2. The voltage applied in step 94 between the electrospinnable coaxial nozzle 10 and the collection plate 30 may depend on other electrospinning parameters of the hydrophobic coaxial fiber electrospinning system 100 such as, for example, the type and weight percent of the electrospinnable polymer in the electrospinnable core solution 12, the diameter of the core outlet 13, the core flow rate, the type and weight percent of the hydrophobic material in the hydrophobic sheath solution 16, the diameter of the sheath outlet 17, the sheath flow rate, and/or distance D between the electrospinning coaxial nozzle 10 and the collection plate 30 and/or any other electrospinning parameters. For example, in one embodiment, the voltage applied in step 94 may comprise from about 5 kilovolts (kV) to about 30 kV. In another embodiment, such as where the distance D between the electrospinnable coaxial nozzle 10 and the collection plate 30 comprises from about 20 cm to about 25 cm, the voltage applied in step 94 may comprise about 12.5 kV. In yet another embodiment, the voltage applied in step 94 may be about 1 kV for every 1 cm of distance D between the electrospinnable coaxial nozzle 10 and the collection plate 30.

Furthermore, the voltage may be applied in step 94 between the electrospinnable coaxial nozzle 10 and the collection plate in any sufficient manner to allow for the electrospinning of the electrospun hydrophobic coaxial fiber 40. For example, as in one embodiment, as illustrated in FIG. 1, the power supply 20 may be connected to the electrospinnable coaxial nozzle 10 by an electrospinnable coaxial nozzle power supply connection 21. Likewise, the power supply 20 may be connected to the collection plate 30 by a collection plate power supply connection 22. The electrospinnable coaxial nozzle power supply connection 21 and the collection plate power supply connection 22 can comprise conductive alligator clips, conductive wire wrapped around the electrospinnable coaxial nozzle 10 and/or the collection plate 30, or any other similar connection or combinations thereof.

Similar to the electrospinning coaxial nozzle 10, the collection plate 30 can comprise any conductive material such that a voltage supplied from a power supply 20 can be transferred through the collection plate. For example, the collection plate 30 can comprise any conductive metal, alloy, or other electrically conductive material. Furthermore, the electrospinning coaxial nozzle 10 may be separated from the collection plate 30 by any distance D that allows both the electrospinnable core solution 12 and the hydrophobic sheath solution 16 enough travel time for their respective solvents to evaporate to form the electrospun hydrophobic coaxial fiber 40. For example, in one embodiment, the distance D between the electrospinning coaxial nozzle 10 and the collection plate 30 may comprise less than or equal to 50 centimeters (cm). In another embodiment, the distance D between the electrospinning coaxial nozzle 10 and the collection plate 30 may comprise less than or equal to 30 cm. In yet another embodiment, the distance D between the electrospinning coaxial nozzle 10 and the collection plate 30 may comprise from about 20 cm to about 25 cm.

The resulting electrospun hydrophobic coaxial fiber 40 electrospun from the hydrophobic coaxial fiber electrospinning system 100 thereby comprises an electrospinnable polymer core 41 (derived from the electrospinnable core solution 12) coated with a hydrophobic sheath material 42 (derived from the hydrophobic sheath solution 16) as illustrated in FIG. 2. The electrospun hydrophobic coaxial fiber 40 can comprise a fiber diameter that is dependant on, among other things, the diameters of the core outlet 13 and the sheath outlet 17, the flow rates, the weight percents of the electrospinnable polymers and the hydrophobic material and/or other electrospinning parameters. For example, in one embodiment, the electrospun hydrophobic coaxial fiber 40 may comprise a fiber diameter of 0.2 μm to 2 μm. Among other properties, the electrospinnable polymer core 41 can provide mechanical strength to the electrospun hydrophobic coaxial fiber 40 while the hydrophobic sheath material 42 can provide hydrophobic, oleophobic and/or chemical resistance properties to the electrospun hydrophobic coaxial fiber 40. Furthermore, the hydrophobic sheath material 42 may comprise any weight percent of the electrospun hydrophobic coaxial fiber 40 relative to the electrospinnable polymer core 41 as a result of electrospinning which can depend on, for example, the type and weight percent of the electrospinnable polymer in the electrospinnable core solution 12, the diameter of the core outlet 13, the core flow rate, the type and weight percent of the hydrophobic material in the hydrophobic sheath solution 16, the diameter of the sheath outlet 17, the sheath flow rate, and/or any other electrospinning parameters. In one embodiment, the hydrophobic sheath material comprise from about 1 weight percent to about 10 weight percent of the electrospun coaxial fiber 40. In another embodiment, the hydrophobic sheath material comprise from about 7 weight percent to about 9 weight percent of the electrospun coaxial fiber 40. In another embodiment, (such as where the electrospinnable core solution 12 comprises 10 weight percent poly(∈-caprolactone) and 90 weight percent trifluoroethanol and has a core flow rate of about 1.5 mL/h, the hydrophobic sheath solution 16 comprises 1 weight percent Teflon AF 2400 and 99 weight percent FC-75 and has a sheath flow rate of about 1.0 mL/h, 12.5 kV are applied and the electrospinnable coaxial nozzle 10 is separated from the collection plate 30 by a distance D of about 25 cm), the hydrophobic sheath material may comprise about 8 weight percent of the electrospun hydrophobic coaxial fiber 40. The electrospinning of the hydrophobic coaxial fiber 40 may thus allow for a more efficient and/or less expensive application of the hydrophobic material on the electrospun polymer than may be achieved through chemical deposition, submersion or other alternative methods.

Referring still to FIGS. 1-3, as the voltage is applied in step 94 of method 90, the electrospun hydrophobic coaxial fiber 40 is collected on the collection plate in step 95 to yield a superhydrophobic coaxial fiber mat 50. Specifically, the one or more electrospun hydrophobic coaxial fiber 40 are grouped on the collection plate 30 as they settle from the electrospinning. The electrospun hydrophobic coaxial fiber 40 can group in any random orientation or configuration, or alternatively, can be manipulated such that the electrospun hydrophobic coaxial fibers 40 are aligned on the collection plate 30. Furthermore, the superhydrophobic coaxial fiber mat 50 can comprise any dimensions and orientations of the electrospun hydrophobic coaxial fiber 40. For example, in one embodiment, such as that illustrated in FIGS. 1 and 3, the superhydrophobic coaxial fiber mat 50 can comprise one or more hydrophobic coaxial fibers 40 randomly oriented and stacked. In another embodiment, the superhydrophobic coaxial fiber mat 50 may comprise one or more oriented hydrophobic coaxial fibers 40. Furthermore, in one embodiment, such as where the distance D between the electrospinnable coaxial nozzle 10 and the collection plate 30 comprises about 25 cm, the superhydrophobic coaxial fiber mat 50 may comprise a length and a width of about 5 cm. In one embodiment, the collection plate 30 may remain stationary relative the electrospinnable coaxial nozzle 10 during the collection of the hydrophobic coaxial fiber in step 95. In another embodiment, such as when a greater length and width are desired for the superhydrophobic coaxial fiber mat 50 for a similar distance D between the electrospinnable coaxial nozzle 10 and the collection plate 30, the collection plate 30 may continuously, incrementally or otherwise move relative the coaxial nozzle 10 during the collection of hydrophobic coaxial fiber in step 95. Furthermore, the superhydrophobic coaxial fiber mat 50 can comprise any thickness which can depend on the diameter of the electrospun hydrophobic coaxial fiber 40 electrospun during method 90, as well as the amount of time the electrospun hydrophobic coaxial fiber 40 is electrospun and collected in method 90.

Figure 4:
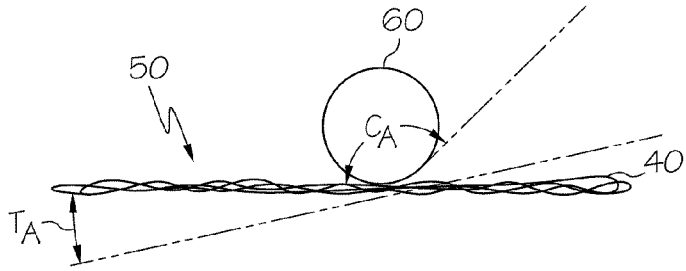
FIG. 4 depicts a droplet on a hydrophobic coaxial fiber mat according to one or more embodiments shown and described herein.

The superhydrophobic coaxial fiber mat 50 formed from method 90 (such as by using the hydrophobic coaxial fiber electrospinning system 100 as described above), can possess significant hydrophobic, oleophobic and/or chemical resistance properties. Specifically, as a result of the hydrophobicity of the electrospun hydrophobic coaxial fiber 40, as well as the relatively rough surface morphology of the superhydrophobic coaxial fiber mat 50, the superhydrophobic coaxial fiber mat 50 formed from method 90 can be superhydrophobic. As discussed above, "superhydrophobic" refers to possessing a contact angle greater than or equal to 150° with water. For example, referring to FIG. 4, a superhydrophobic coaxial fiber mat 50 comprising hydrophobic coaxial fibers 40 is illustrated with a droplet 60 disposed thereon. A contact angle $C_A$ is measured by the angle in which the droplet 60 interface meets the superhydrophobic coaxial fiber mat 50 as illustrated. Greater contact angles $C_A$ represent greater hydrophobic properties while smaller contact angles $C_A$ represent greater hydrophilic properties. In one embodiment, the superhydrophobic coaxial fiber mat 50 possesses a contact angle $C_A$ greater than or equal to 150° with water (i.e. the droplet 60 comprises water). In another embodiment, the superhydrophobic coaxial fiber mat 50 possesses a contact angle $C_A$ greater than or equal to 150° with water. Furthermore, the superhydrophobic coaxial fiber mat 50 may also posses a rolling angle $T_A$ (or angle of tilt) of less than or equal to 10° with water. Smaller rolling angles $T_A$ represent greater hydrophobic properties while larger rolling angles $R_A$ represent greater hydrophilic properties. For example, still referring to FIG. 4, a rolling angle $T_A$ is measured by the angle of tilt a surface must undergo before the droplet 60 rolls off. The rolling angle $T_A$ may be indicative of the dynamic hydrophobicity of a material by simulating movement between the material and the droplet as can often occur. In one embodiment, the superhydrophobic coaxial fiber mat 50 possesses a rolling angle $T_A$ less than or equal to 10° with water. In another embodiment, the superhydrophobic coaxial fiber mat 50 possesses a rolling angle $R_A$ less than or equal to 5° with water.

As mentioned above, the superhydrophobic coaxial fiber mat 50 may further be oleophobic and/or chemically resistant. As used herein, oleophobic refers to possessing an alkane contact angle greater than or equal to 90° with alkanes. For example, in one embodiment, the superhydrophobic coaxial fiber mat 50 possesses an alkane contact angle $C_A$ greater than or equal to 120° with alkanes. In another embodiment, the superhydrophobic coaxial fiber mat 50 possesses an alkane contact angle $C_A$ greater than or equal to 120° or 130° with alkanes. Also as used herein, "chemically resistant" refers to resisting chemical degradation due to contact with other chemicals. For example, the superhydrophobic coaxial fiber mat 50 may be chemically resistant to chemicals that would typically degrade or dissolve the electrospinnable polymer core 41 such as, for example, trifluoroethanol.

The method 90 for electrospinning an electrospun hydrophobic coaxial fiber 40 into a superhydrophobic coaxial fiber mat 50 may be conducted in any atmospheric conditions that allow for the electrospinning of the electrospun hydrophobic coaxial fiber 40 from the electrospinnable core solution 12 and the hydrophobic sheath solution 16. For example, the method 90 may be conducted at or about room temperature, at or about atmospheric pressure, in a standard environment or in an inert atmosphere, or variations thereof so long as the charged electrospinnable polymer can travel from the electrospinnable coaxial nozzle 10 to the collection plate 30 under the presence of the electric field such that the core solvent evaporates from the electrospinnable core solution and the sheath solvent evaporates from the hydrophobic sheath solution 16.

Example 1

In the following exemplary method 90 of using a hydrophobic coaxial fiber electrospinning system 100, hydrophobic coaxial fibers were electrospun and collected to produce superhydrophobic coaxial fiber mats 50. The electrospinnable core solution 12 comprised 10 weight percent poly(∈-caprolactone) and 90 weight percent trifluoroethanol. For a first superhydrophobic coaxial fiber mat 50, the hydrophobic sheath solution 16 comprised 1 weight percent Teflon AF 2400 and 99 weight percent FC-75. For a second superhydrophobic coaxial fiber mat 50, the hydrophobic sheath solution 16 comprised 0.5 weight percent Teflon AF 2400 and 99.5 weight percent FC-75. The electrospinnable core solution 12 was ejected from the core outlet 13 of the electrospinning coaxial nozzle 10 at a core flow rate of about 1.5 mL/h. The hydrophobic sheath solution 16 was ejected from the sheath outlet 17 of the electrospinning coaxial nozzle 10 at a sheath flow rate of about 1.0 mL/h. The voltage applied between the electrospinning coaxial nozzle 10 and the collection plate 30 was about 12.5 kV. Finally, the electrospinnable coaxial nozzle 10 was separated from the collection plate 30 by a distance D of about 25 cm. The first superhydrophobic coaxial fiber mat 50 (hydrophobic sheath solution with 1 weight percent Teflon AF 2400) was measured to comprise 8.8 weight percent Teflon AF 2400 and the second superhydrophobic coaxial fiber mat 50 (hydrophobic sheath solution with 0.5 weight percent Teflon AF 2400) was measured to comprise 3.3 weight percent Teflon AF 2400.

The contact angle $C_A$ of the first superhydrophobic coaxial fiber mat 50 (hydrophobic sheath solution with 1 weight percent Teflon AF 2400) was measured for water to be 158° and the contact angle $C_A$ of the second superhydrophobic coaxial fiber mat 50 (hydrophobic sheath solution with 0.5 weight percent Teflon AF 2400) was measured for water to be 153°. For comparisons the contact angles $C_A$ between a poly(∈-caprolactone) film, a poly(∈-caprolactone) fiber mat, and a Teflon AF 2400 film were also determined. The contact angle $C_A$ of the poly(∈-caprolactone) film was measured for water to be 59°. The contact angle $C_A$ of the poly(∈-caprolactone) fiber mat was measured for water to be 125°. The contact angle $C_A$ of the Teflon AF 2400 film was measured for water to be 120°. Thus, not only were the contact angles $C_A$ for the superhydrophobic coaxial fiber mats 50 (158° and 153°) greater than the contact angle for the poly(∈-caprolactone) fiber mat (59°), but they were also significantly greater than the contact angles $C_A$ for the poly(∈-caprolactone) fiber mat (125°) and the Teflon AF 2400 film (120°).

Furthermore, rolling angles $T_A$ for the first superhydrophobic coaxial fiber mat 50 (hydrophobic sheath solution with 1 weight percent Teflon AF 2400), the second superhydrophobic coaxial fiber mat 50 (hydrophobic sheath solution with 0.5 weight percent Teflon AF 2400), the poly(∈-caprolactone) fiber mat, and the Teflon AF 2400 film were also determined. The rolling angle for the first superhydrophobic coaxial fiber mat 50 (hydrophobic sheath solution with 1 weight percent Teflon AF 2400), was measured to be about 7°. The rolling angle for the second superhydrophobic coaxial fiber mat 50 (hydrophobic sheath solution with 0.5 weight percent Teflon AF 2400), was measured to be about 20°. The rolling angle for the poly(∈-caprolactone) fiber mat was measured to greater than 90°. Finally, the rolling angle for the Teflon AF 2400 film was measured to be about 25°. Thus, both the first superhydrophobic coaxial fiber mat 50 (hydrophobic sheath solution with 1 weight percent Teflon AF 2400) and the second superhydrophobic coaxial fiber mat 50 (hydrophobic sheath solution with 0.5 weight percent Teflon AF 2400) showed increased dynamic hydrophobicity through improved rolling angles.

In addition, the oleophobic properties of the first superhydrophobic coaxial fiber mat 50 (hydrophobic sheath solution with 1 weight percent Teflon AF 2400) were compared to those of the poly(∈-caprolactone) fiber mat. When a 2 μL droplet of dodecane (~23 mN/m) was placed on the poly(∈-caprolactone) fiber mat, the dodecane spread thoroughly and its alkane contact angle was almost 0°. However, when a 2 μL droplet of dodecane (~23 mN/m) was placed on the first superhydrophobic coaxial fiber mat 50 (hydrophobic sheath solution with 1 weight percent Teflon AF 2400), the first superhydrophobic coaxial fiber mat 50 (hydrophobic sheath solution with 1 weight percent Teflon AF 2400) had an alkane contact angle $C_A$ of about 130°.

Finally, the mechanical properties of the first superhydrophobic coaxial fiber mat 50 (hydrophobic sheath solution with 1 weight percent Teflon AF 2400), the second superhydrophobic coaxial fiber mat 50 (hydrophobic sheath solution with 0.5 weight percent Teflon AF 2400), the poly(∈-caprolactone) fiber mat were determined. The first superhydrophobic coaxial fiber mat 50 (hydrophobic sheath solution with 1 weight percent Teflon AF 2400) was found to have an ultimate tensile strength (UTS) of 2.3 MPa, a maximum strain of 9.6 mm/mm and a stiffness of 13.0 MPa. The second superhydrophobic coaxial fiber mat 50 (hydrophobic sheath solution with 0.5 weight percent Teflon AF 2400) was found to have an ultimate tensile strength (UTS) of 2.23 MPa, a maximum strain of 8.5 mm/mm and a stiffness of 8.9 MPa. Finally, the poly(∈-caprolactone) fiber mat was found to have an ultimate tensile strength (UTS) of 3.1 MPa, a maximum strain of 6.3 mm/mm and a stiffness of 6.3 MPa. These measurements show that while the stiffness is increased for the first and second superhydrophobic coaxial fiber mats 50 (as a result of the addition of Teflon AF 2400), the mechanical properties of the core poly(∈-caprolactone) remained.

Example 2

In the following exemplary method 90 of using a hydrophobic coaxial fiber electrospinning system 100, hydrophobic coaxial fibers were electrospun and collected to produce superhydrophobic coaxial fiber mats 50. The electrospinnable core solution 12 comprised 10 weight percent poly(∈-caprolactone) and 90 weight percent trifluoroethanol. For the superhydrophobic coaxial fiber mat 50, the hydrophobic sheath solution 16 comprised 1 weight percent Teflon AF 2400 and 99 weight percent FC-75. The electrospinnable core solution 12 was ejected from the core outlet 13 of the electrospinning coaxial nozzle 10 at a core flow rate of about 1.5 mL/h. The hydrophobic sheath solution 16 was ejected from the sheath outlet 17 of the electrospinning coaxial nozzle 10 at a sheath flow rate of about 1.0 mL/h. The voltage applied between the electrospinning coaxial nozzle 10 and the collection plate 30 was about 13 kV. Finally, the electrospinnable coaxial nozzle 10 was separated from the collection plate 30 by a distance D of about 25 cm. Trifluoroethanol vapor was then applied to the superhydrophobic coaxial fiber mat 50 and micrographs were taken at 0 minute (FIG. 5A), 5 minute (FIG. 5B), 10 minute (FIG. 5C) and 20 minute (FIG. 5D) intervals of the trifluoroethanol vapor application. As shown in FIG. 5, the trifluoroethanol vapor had little to no effect on the superhydrophobic coaxial fiber mats 50 through 10 minutes and resulted in only weak swelling at 20 minutes.

Conversely, an electrospun poly(∈-caprolactone) fiber mat was also subjected to trifluoroethanol vapor. As shown in FIG. 6, comparable micrographs were taken at 0 minute (FIG. 6A), 3 minute (FIG. 6B), 10 minute (FIG. 6C) and 20 minute (FIG. 6D) intervals of the trifluoroethanol vapor application. As opposed to the superhydrophobic coaxial fiber mats 50, the poly(∈-caprolactone) fiber mat showed significant degradation after just 3 minutes and turned into a film at or before 10 minutes. Thus, the Teflon AF 2400 coating for the superhydrophobic coaxial fiber mat 50 significantly resisted the degradation affect that the trifluoroethanol vapor can have on the poly(∈-caprolactone) core material.

It should now be appreciated that superhydrophobic coaxial fiber mats can be formed by electrospinning hydrophobic coaxial fibers from electrospinnable core solutions and hydrophobic sheath solutions. The hydrophobic sheath solution, which may not be electrospinnable on its own due to a low dielectric constant, can be electrospun in combination with the electrospinnable core solution to provide an efficient method for producing hydrophobic coaxial fibers. Furthermore, as a result of the hydrophobic material and the morphology of the collected hydrophobic coaxial fibers, the superhydrophobic coaxial fiber mats can possess increased hydrophobic, oleophobic and/or chemical resistance properties.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method for electrospinning a hydrophobic coaxial fiber into a superhydrophobic coaxial fiber mat, the method comprising:

providing an electrospinning coaxial nozzle comprising a core outlet coaxial with a sheath outlet;

ejecting an electrospinnable core solution from the core outlet of the electrospinning coaxial nozzle;

ejecting a hydrophobic sheath solution from the sheath outlet of the electrospinning coaxial nozzle, wherein the hydrophobic sheath solution annularly surrounds the electrospinnable core solution;

applying a voltage between the electrospinning coaxial nozzle and a collection plate, wherein the voltage induces a jet of the electrospinnable core solution annularly surrounded by the hydrophobic sheath solution to travel from the electrospinning coaxial nozzle to the collection plate to form the hydrophobic coaxial fiber comprising an electrospinnable polymer core coated with a hydrophobic sheath material; and wherein collection of the hydrophobic coaxial fiber on the collection plate yields the superhydrophobic coaxial fiber mat, and the superhydrophobic coaxial fiber mat possesses a contact angle greater than or equal to 150° with water.

2. The method of claim 1 wherein the superhydrophobic coaxial fiber mat possesses a rolling angle less than or equal to 10° with water.

3. The method of claim 1 wherein the superhydrophobic coaxial fiber mat possesses a contact angle greater than or equal to 120° with alkanes.

4. The method of claim 1 wherein the hydrophobic sheath solution comprises the hydrophobic sheath material and a sheath solvent.

5. The method of claim 4 wherein the hydrophobic sheath material comprises a fluoropolymer.

6. The method of claim 5 wherein the hydrophobic sheath material comprises an amorphous copolymer of polytetrafluoroethylene and 2,2-bis(trifluoromethyl)-4,5-difluoro-1,3-dioxole, amorphous fluoropolymers, and/or fluoroaliphatic polymers.

7. The method of claim 4 wherein the hydrophobic sheath material comprises 0.2 weight percent to 2 weight percent of the hydrophobic sheath solution.

8. The method of claim 1 wherein the electrospinnable core solution comprises an electrospinnable polymer and a core solvent.

9. The method of claim 8 wherein the electrospinnable polymer comprises poly(∈-caprolactone), poly(methyl methacrylate), nylon, polyurethane, poly-lactic gycolic acid, polyethylene, poly(lactic acid), poly(ethylene oxide), polystyrene, polycarbonate, polyvinyl alcohol, polyvinylpyrrolidone, polyacrylonitrile, poly(isophthaloylchloride/m-phenylenediamine), DNA-CTMA, cellulose acetate, collagen, gelatin, and/or chitosan.

10. The method of claim 9 wherein the core solvent comprises trifluoroethanol, hexafluoro-iso-propanol, chloroform, tretrahydrofuran, dimethylformamide, methylene chloride, water and/or formic acid.

11. The method of claim 8 wherein the electrospinnable polymer comprises 4 weight percent to 35 weight percent of the electrospinnable core solution.

* * * * *